US007394213B2

(12) United States Patent
Huang et al.

(10) Patent No.: US 7,394,213 B2
(45) Date of Patent: Jul. 1, 2008

(54) MULTI-LAMP DRIVER

(75) Inventors: Chung-Jung Huang, Taoyuan County (TW); Yung-Yi Hsu, Taipei (TW)

(73) Assignee: QISDA Corporation, Taoyuan (TW)

( * ) Notice: Subject to any disclaimer, the term of this patent is extended or adjusted under 35 U.S.C. 154(b) by 0 days.

(21) Appl. No.: 11/459,964

(22) Filed: Jul. 26, 2006

(65) Prior Publication Data

US 2007/0024212 A1 Feb. 1, 2007

(30) Foreign Application Priority Data

Jul. 27, 2005 (TW) ..... 94125413 A

(51) Int. Cl.
*H05B 37/02* (2006.01)
*H05B 41/24* (2006.01)
*H05B 37/00* (2006.01)

(52) U.S. Cl. ..... 315/307; 315/213; 315/220; 315/277; 315/320; 315/324

(58) Field of Classification Search ..... 315/209 R, 315/210, 211, 212, 213, 219, 220, 225, 226, 315/291, 307, 312, 320, 324, 276, 277
See application file for complete search history.

(56) References Cited

U.S. PATENT DOCUMENTS 6,717,372 B2 * 4/2004 Lin et al. ..... 315/282
7,045,967 B2 * 5/2006 Chen et al. ..... 315/224

FOREIGN PATENT DOCUMENTS

| | | |
|---|---|---|
| TW | 595265 | 6/2004 |
| TW | M261649 | 4/2005 |

OTHER PUBLICATIONS

Taiwan Office Action mailed Aug. 31, 2006.

* cited by examiner

*Primary Examiner*—Thuy Vinh Tran
(74) *Attorney, Agent, or Firm*—Thomas, Kayden, Horstemeyer & Risley

(57) ABSTRACT

A multi-lamp driver t disclosed, comprising a power driver coupled to a plurality of lamps to supply power thereto, a feedback circuit coupled to at least one of the lamps to generate a feedback signal, a control circuit coupled between the feedback circuit and the power driver to control the power driver according to an illumination control signal and the feedback signal for total illumination adjustment of the lamps, and at least one switch controlled by the control circuit to turn at least one of the lamps on or off. In a total illumination adjustment of the lamps, the switch turns on or off timely. The difference between the maximum and minimum value of the total illumination of the lamps is thus increased.

14 Claims, 11 Drawing Sheets

MULTI-LAMP DRIVER

BACKGROUND OF THE INVENTION

1. Field of the Invention

The invention relates to a multi-lamp driver and more particularly to a multi-lamp driver used in a LCD backlight module.

2. Description of the Related Art

Illumination control of a backlight module in a LCD panel is typically realized by adjusting current in each lamp simultaneously. However, due to lamp nature, maximum and minimum values of current in each lamp are limited, resulting in insufficient difference between maximum and minimum value of total lamp illumination. This leads to poor performance, or even failure to comply with TCO03 standards.

FIG. 1 is a schematic diagram of a conventional multi-lamp driver 100 driving a first lamp $Lp_1$ and second lamp $Lp_2$. The multi-lamp driver 100 comprises a power driver 102, a feedback circuit 106, and a control circuit 108. The power driver 102 comprises a driving circuit 104 and a transformer T1. The driving circuit 104 converts DC voltage Vin to AC voltage, provided to a primary coil of the transformer T1. A secondary coil of the transformer T1 is coupled to high voltage ends of the first lamp T1 and second lamp T2 to provide power to the first lamp T1 and second lamp T2. The feedback circuit 106 is coupled to low voltage ends of the two lamps to generate a feedback signal $S_f$ to the control circuit 108. The control circuit 108 then controls the driving circuit 104 based on an illumination control signal $S_b$ and the feedback signal $S_f$, such that the AC voltage produced by the driving circuit 104 provides the two lamps $Lp_1$ and $Lp_2$ with stable illumination.

FIG. 2 is a schematic diagram of another conventional multi-lamp driver 200, comprising a power driver 202, a controlling circuit 104, a feedback circuit 106, and a control circuit 108. Here, multi-lamp driver 200 comprises two transformers T1 and T2 with secondary coils coupled respectively to high voltage ends of lamps $Lp_1$ and $Lp_2$ through capacitors C1 and C2. Further, the feedback circuit 106 is coupled to the secondary coil of the transformer T2 rather than to the low voltage ends of lamps $Lp_1$ and $Lp_2$. All other aspects of multi-lamp driver 100 and 200 are the same. Similarly, the control circuit 108 controls the driving circuit 104 based on an illumination control signal $S_b$ and a feedback signal $S_f$ received from the feedback circuit 104, such that the AC voltage produced by the driving circuit 104 provides the two lamps $Lp_1$ and $Lp_2$ with stable illumination.

As shown in FIGS. 1 and 2, illumination in both the multi-lamp drivers 100 and 200 is controlled by changing the AC voltage generated by the control circuit 108 to control currents of the lamps $Lp_1$ and $Lp_2$. During illumination adjustment, current in lamps $Lp_1$ and $Lp_2$ varies in the same manner and lamps $Lp_1$ and $Lp_2$ are turned on and off simultaneously. However, maximum and minimum current in the lamps $Lp_1$ and $Lp_2$ is limited, resulting in unobvious difference between maximum and minimum total lamp illumination of a panel. In view of such a problem, a multi-lamp driver with increased illumination range is called for.

BRIEF SUMMARY OF THE INVENTION

The invention discloses a multi-lamp driver with decreased minimum value of total lamp illumination. The multi-lamp driver comprises at least one switch turning off lamp(s) at a desired time, decreasing minimum value and thereby increasing range of total lamp illumination.

The multi-lamp driver of the invention comprises a power driver coupled to a plurality of lamps to supply power to the lamps, a feedback circuit coupled to at least one of the lamps to generate a feedback signal, a control circuit coupled between the feedback circuit and the power driver to control the power driver according to an illumination control signal for adjustment of lamp illumination, and at least one switch controlled by the control circuit to turn at least one of the lamps on and off. Since the invention adjusts not only current in each lamp but also incidents of turning on lamps, minimum value of total lamp illumination can be lower than conventional drivers.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
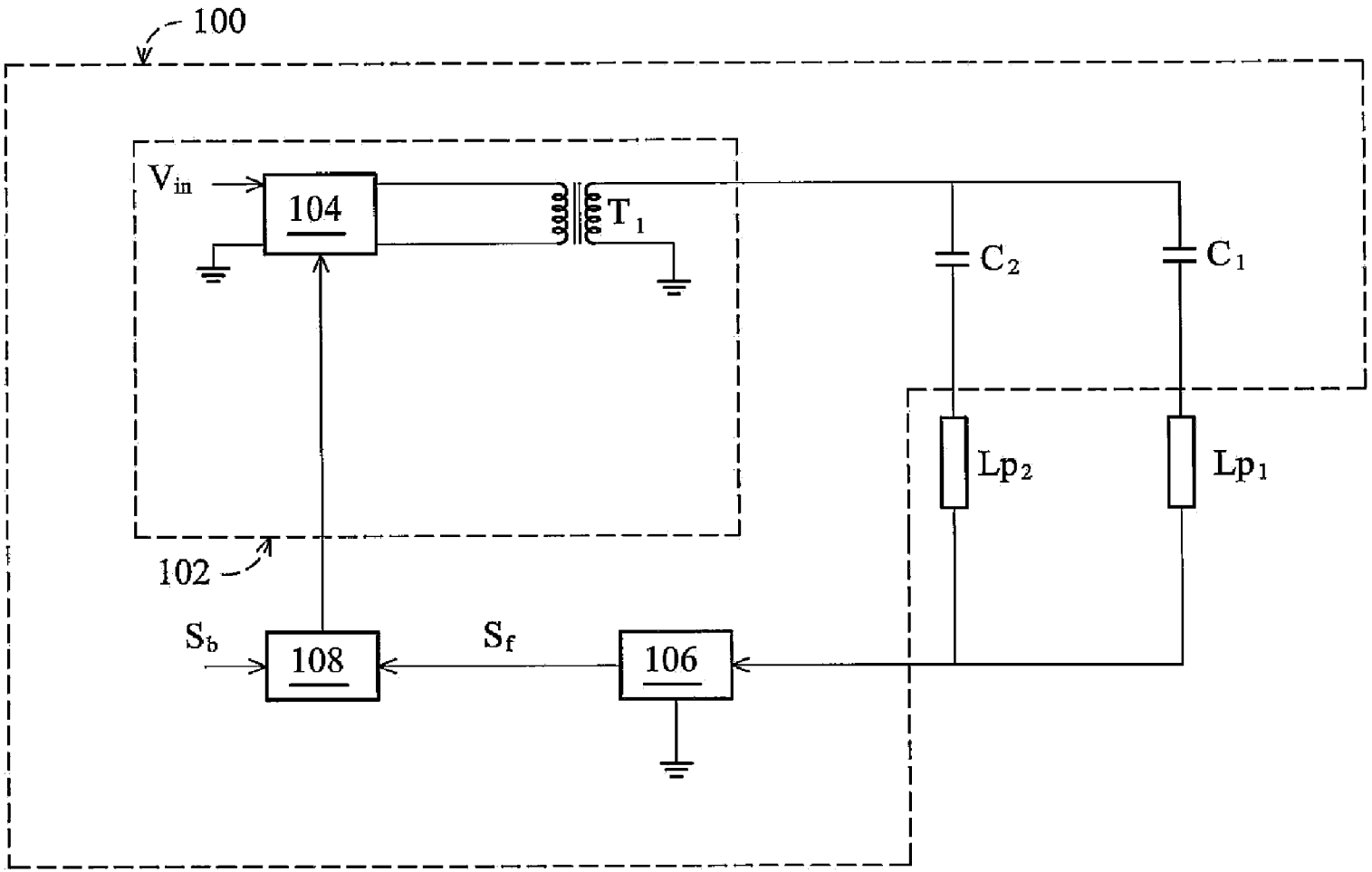
FIG. 1 ( RELATED ART )
FIG. 1 is a schematic diagram of a conventional multi-lamp driver.
Figure 3:
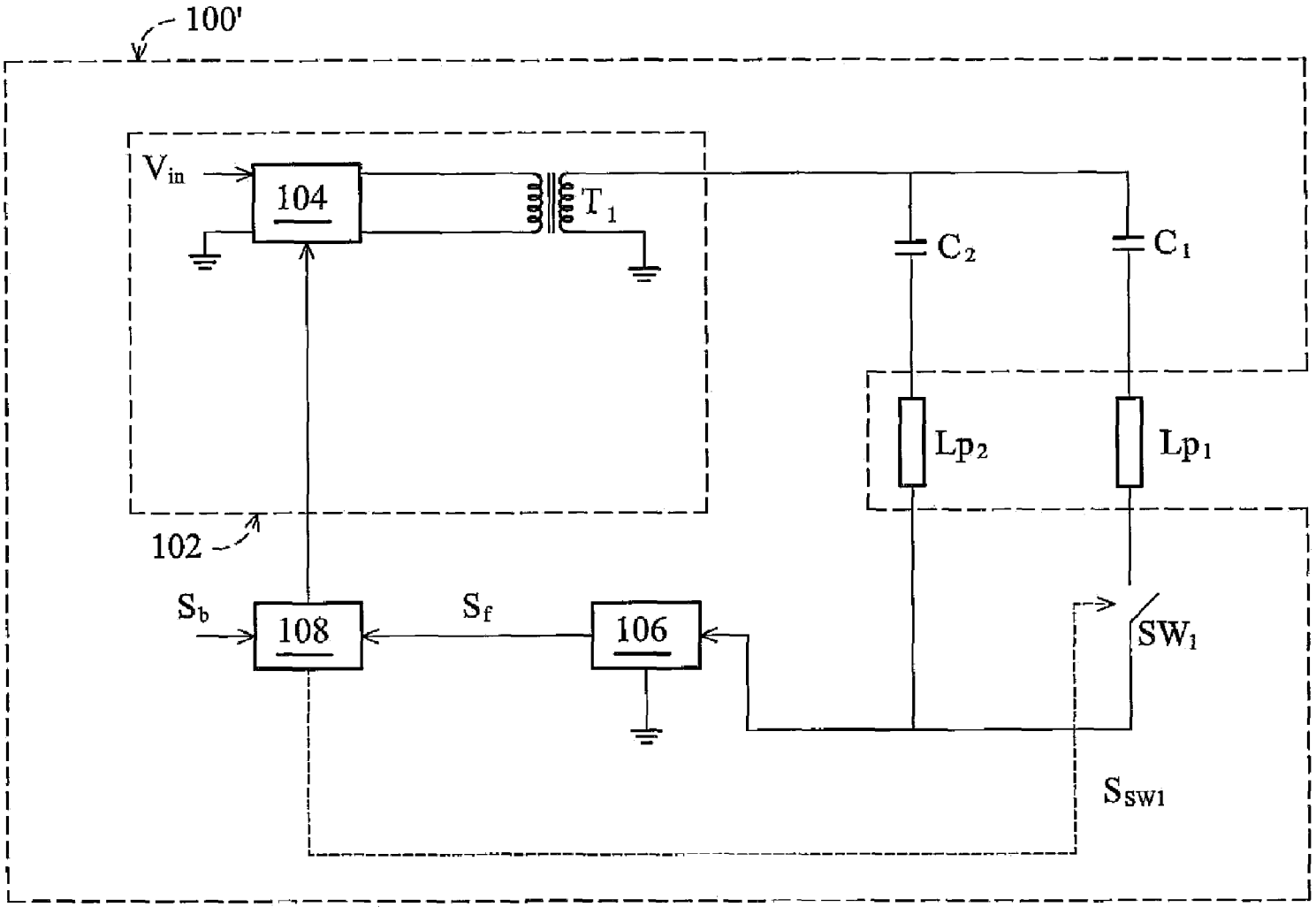
FIG. 3 is a schematic diagram of a multi-lamp driver in accordance with an embodiment of the invention.

FIG. 3 is a schematic diagram of a multi-lamp driver in accordance with an embodiment of the invention. The multi-lamp driver 100' also drives the first and second lamps $Lp_1$ and $Lp_2$ like the multi-lamp driver 100' shown in FIG. 1. The only difference between the multi-lamp drivers 100' and 100 is that an additional switch $SW_1$ is inserted between the feedback circuit 106 and a low voltage end of the first lamp $Lp_1$, controlled by a switch control signal $S_{SW1}$ generated by the control circuit 108. When the switch $SW_1$ is turned off, the only lamp conducting is the second lamp $Lp_2$, and the feedback circuit 106 coupled to the second lamp $Lp_2$ continues outputting the feedback signal $S_f$ to the control circuit 108 such that illumination of the second lamp $Lp_2$ is controlled. Since only the second lamp $Lp_2$ is conducting, the total lamp illumination is lower than in FIG. 1 in which both the lamps $Lp_1$ and $Lp_2$ are conducting.

The time for the switch control signal $S_{SW1}$ to turn on the first lamp $Lp_1$ is set according to design requirements. In an embodiment, a predetermined illumination value is established. When the illumination control signal $S_b$ sets the total lamp illumination lower than the predetermined value, the switch control signal $S_{SW1}$ turns off the switch $SW_1$. When the illumination control signal $S_b$ sets the total lamp illumination higher than the predetermined value, the switch control signal $S_{SW1}$ turns on the switch $SW_1$. Total lamp illumination, when below the predetermined value, is provided by the second lamp $Lp_2$ and can be lowered until the current of the second lamp $Lp_2$ reaches a minimum value. Resultingly, the multi-lamp driver 100' has a lower minimum value of total lamp illumination than the multi-lamp driver 100.

Moreover, when the switch $SW_1$ is turned off/on, the total lamp illumination may descend/ascend suddenly. To solve this problem, the control circuit 108 can control the driving circuit 104 to increase/decrease AC voltage when the switch $SW_1$ is turned off/on to stabilize total lamp illumination.

Figure 2:
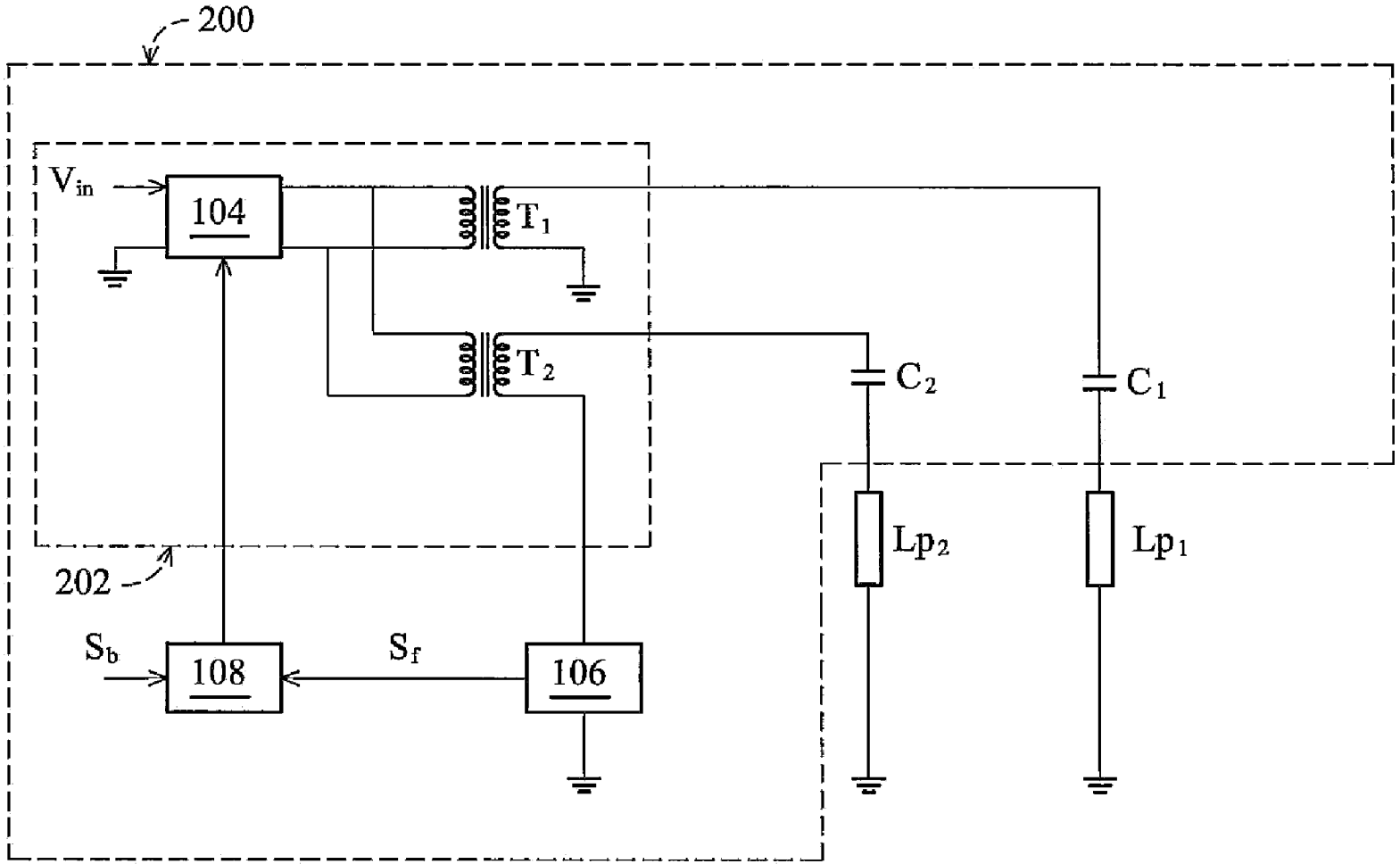
FIG. 2 ( RELATED ART )
FIG. 2 is a schematic diagram of another conventional multi-lamp driver.
Figure 4:
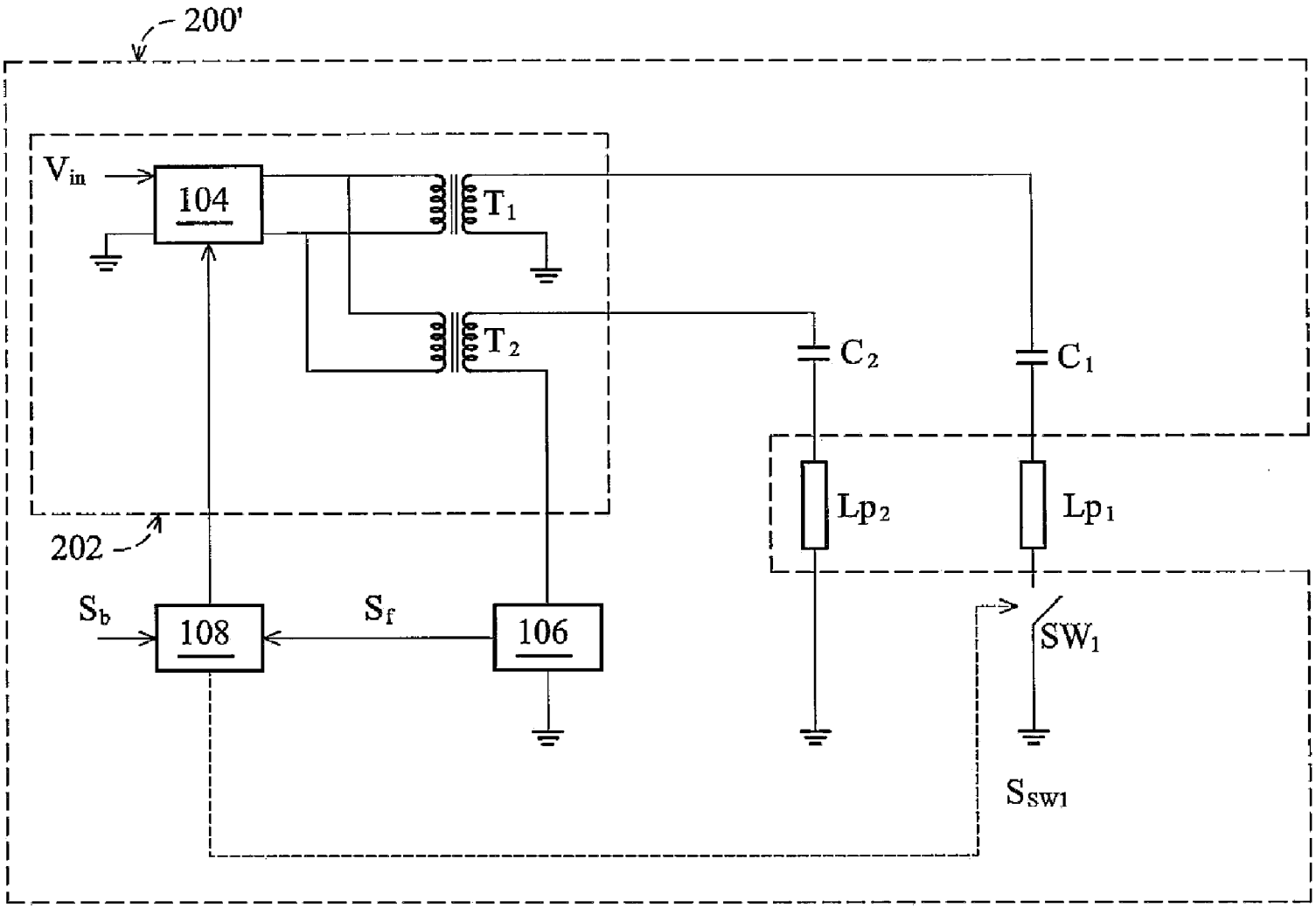
FIG. 4 is a schematic diagram of a multi-lamp driver in accordance with another embodiment of the invention.

FIG. 4 is a schematic diagram of a multi-lamp driver in accordance with another embodiment of the invention. Multi-lamp driver 200' also drives the first and second lamps $Lp_1$ and $Lp_2$ like the multi-lamp driver 200. The only difference between the multi-lamp drivers 200' and 1200 is that here an additional switch $SW_1$ is inserted between the ground and the low voltage end of the first lamp $Lp_1$, wherein the switch $SW_1$ is controlled by a switch control signal $S_{SW1}$ generated by the control circuit 108. When the switch $SW_1$ is turned off, the only lamp conducting is the second lamp $Lp_2$, and the feedback circuit 106 coupled to the second lamp $Lp_2$ continues outputting the feedback signal $S_f$ to the control circuit 108 such that illumination of the second lamp $Lp_2$ is controlled. Since only the second lamp $Lp_2$ is conducting, total lamp illumination is lower than in FIG. 2 in which both the lamps $Lp_1$ and $Lp_2$ are conducting.

Similarly, the time for the switch control signal $S_{SW1}$ to turn on the first lamp $Lp_1$ is set according to design requirements. In an embodiment, a predetermined illumination values is established. When the illumination control signal $S_b$ sets the total lamp illumination lower than the predetermined value, the switch control signal $S_{SW1}$ turns off the switch $SW_1$. When the illumination control signal $S_b$ sets the total lamp illumination higher than the predetermined value, the switch control signal $S_{SW1}$ turns on the switch $SW_1$. Total lamp illumination, when below the predetermined value, is provided by the second lamp $Lp_2$ and can be lowered until the current of the second lamp $Lp_2$ reaches a minimum value. Resultingly, the multi-lamp driver 200' has a lower minimum value of total lamp illumination than the multi-lamp driver 200.

Moreover, when the switch $SW_1$ is turned off/on, the total lamp illumination may descend/ascend suddenly. To solve this problem, the control circuit 108 can control the driving circuit 104 to increase/decrease AC voltage when the switch $SW_1$ is turned off/on to stabilize total lamp illumination.

Figure 5:
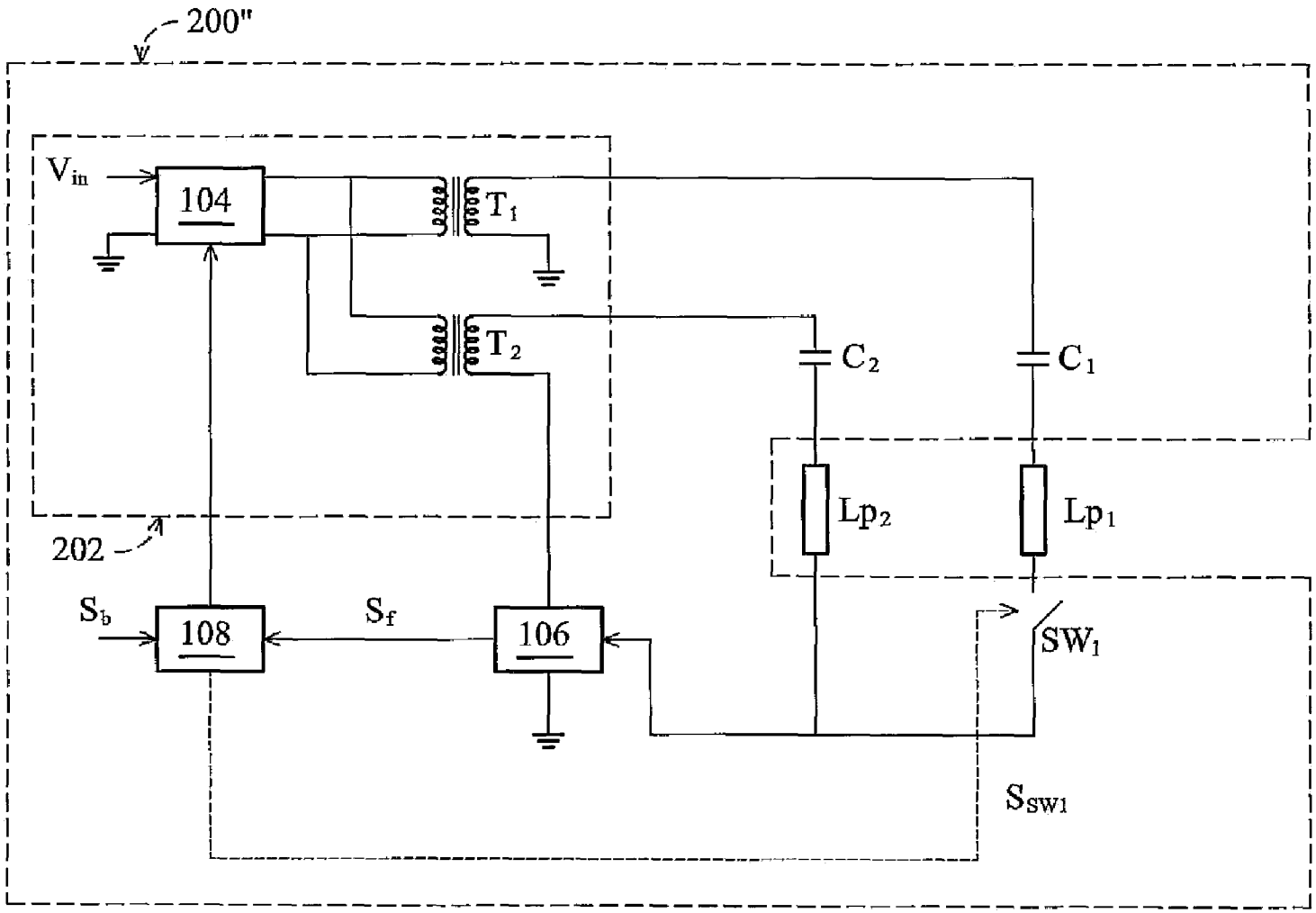
FIG. 5 is a schematic diagram of a multi-lamp driver in accordance with another embodiment of the invention.

FIG. 5 is a schematic diagram of a multi-lamp driver in accordance with another embodiment of the invention. Multi-lamp driver 200" differs from the multi-lamp driver 200' of FIG. 4 only in that the low voltage ends of the lamps $Lp_1$ and $Lp_2$ are coupled to the feedback circuit 106 rather than the ground. Similarly, when the switch $SW_1$ is turned off, the lamp conducting is the second lamp $Lp_2$, and the feedback circuit 106 coupled to the second lamp $Lp_2$ continues outputting the feedback signal $S_f$ to the control circuit 108 such that illumination of the second lamp $Lp_2$ is controlled. Since only the second lamp $Lp_2$ is conducting, total lamp illumination is lower than in FIG. 2 in which both the lamps $Lp_1$ and $Lp_2$ are conducting. Operating details are the same as for multi-lamp driver 200', and not described here for brevity.

The multi-lamp drivers 100', 200' and 200" described above all drive two lamps $Lp_1$ and $Lp_2$. However, this is only for purposes of illustration. It should be obvious to those skilled in the art that the multi-lamp driver of the invention can be extended to drive more than two lamps, as described below.

Figure 6:
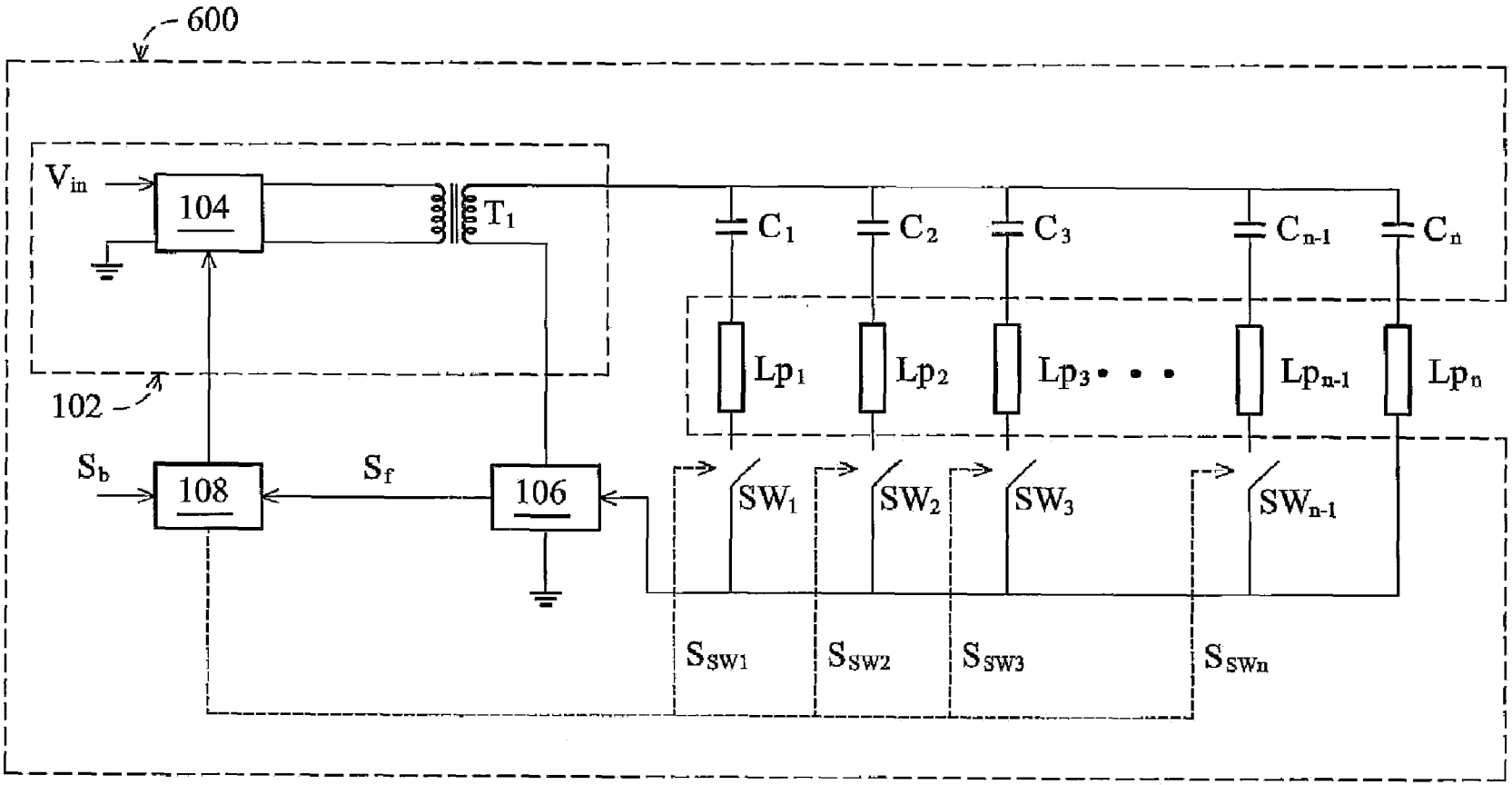
FIG. 6 is a schematic diagram of a multi-lamp driver in accordance with another embodiment of the invention.

FIG. 6 is a schematic diagram of a multi-lamp driver in accordance with another embodiment of the invention. The multi-lamp driver 600, driving a plurality of lamps $Lp_1$ to $Lp_n$, has an extended structure of the multi-lamp driver 100' in FIG. 3. In the multi-lamp driver 600, a transformer $T_1$ is coupled to lamps $Lp_1$ to $Lp_n$ through capacitors $C_1$ to $C_n$, respectively. Switches $SW_1$ to $SW_{n-1}$ are coupled between a feedback circuit 106 and low voltage ends of the lamps $Lp_1$ to $Lp_{n-1}$ respectively, and turned on or off according to switch control signals $S_{SW1}$ to $S_{SW_{n-1}}$ generated by a control circuit 108. When any of the switches is turned off, the lamp coupled to the turned-off switch is turned off responsively, while the feedback circuit 106 remains coupled to the lamps still conducting and outputting a feedback signal $S_f$ to the control circuit 108 such that the total illumination of the lamps t still conducting is controlled. Since not all of the lamps are conducting, the lamps $Lp_1$ to $Lp_n$ driven by the multi-lamp driver 600 can have a lower illumination minimum than conventional drivers in which all the lamps $Lp_1$ to $Lp_n$ are conducting.

Similarly, the respective time for the switch control signal $S_{SW1}$ to $S_{SWn-1}$ to turn on the corresponding lamp $Lp_1$ to $Lp_{n-1}$ is set according to design requirements. For example, a plurality of predetermined illumination values can be established, including a first predetermined value, a second predetermined value, and so on, until the n-1 predetermined value. When the illumination control signal $S_b$ sets the total lamp illumination lower than the first predetermined value, the switch control signal $S_{SW1}$ turns off the switch $SW_1$, and the other switch control signals $S_{SW1}$ to $S_{SWn-1}$ turn on the switches SW2 to SWn-1, respectively. Resutlingly, lamps remaining conducting are the lamps $Lp_2$ to $Lp_n$. Similarly, when the illumination control signal $S_b$ sets the total lamp illumination lower than the second predetermined value, the switch control signal $S_{SW1}$ turns off the switch $SW_1$, the switch control signal $S_{SW2}$ turns off the switch $SW_2$, and the other switch control signals $S_{SW3}$ to $S_{SWn-1}$ turn on the switches $SW_3$ to $SW_{n-1}$, respectively. Resutlingly, lamps left conducting are the lamps $Lp_3$ to $Lp_n$. And so proceed, until only one lamp $Lp_n$ is left conducting.

Figure 7:
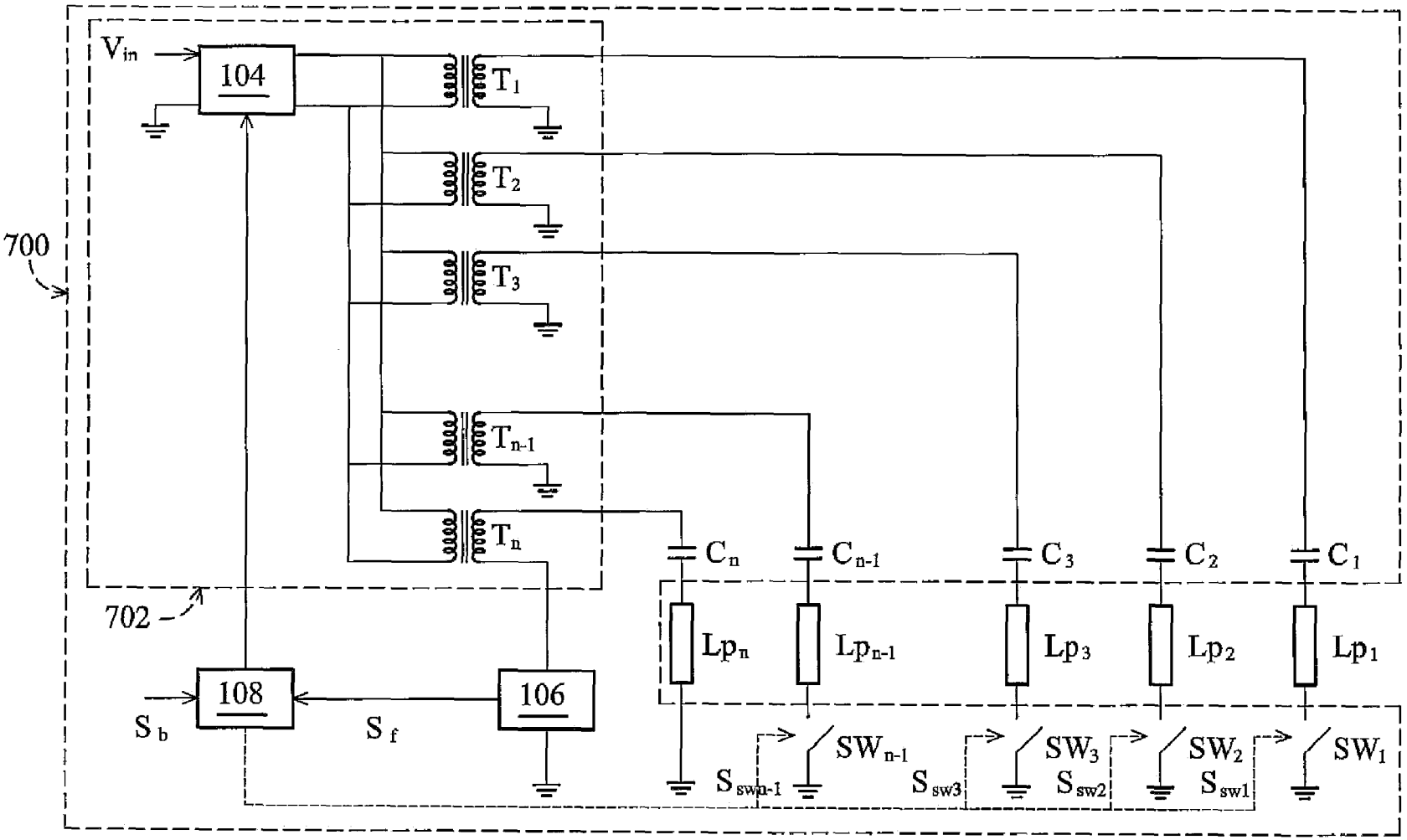
FIG. 7 is a schematic diagram of a multi-lamp driver in accordance with another embodiment of the invention.

Moreover, when the switch $SW_1$ is turned off/on, the total lamp illumination may descend/ascend suddenly. To solve this problem, the control circuit 108 can control the driving circuit 104 to increase/decrease AC voltage when any one of the switches $SW_1$-$SW_{n-1}$ is turned off/on to stabilize the total lamp illumination FIG. 7 is a schematic diagram of a multi-lamp driver in accordance with another embodiment of the invention. The multi-lamp driver 700, driving a plurality of lamps $Lp_1$ to $Lp_n$, has an extension structure of the multi-lamp driver 200' in FIG. 4. In the multi-lamp driver 700, transformers $T_1$ to Tn are coupled to lamps $Lp_1$ to $Lp_n$ through capacitors $C_1$ to $C_n$, respectively. Switches $SW_1$ to $SW_{n-1}$ are coupled between the ground and low voltage ends of the lamps $Lp_1$ to $Lp_{n-1}$, respectively, and turned on or off according to switch control signals $S_{SW1}$ to $S_{SWn-1}$ generated by a control circuit 108. When any of the switches is turned off, the lamp coupled to the turned-off switch is turned off responsively, while the feedback circuit 106 remains coupled to the lamps that are still conducting through the transformer $T_n$ and outputting a feedback signal $S_f$ to the control circuit 108 such that total illumination of the lamps still conducting is controlled. Since not all of the lamps are conducting, the lamps $Lp_1$ to $Lp_n$ driven by the multi-lamp driver 700 can have a lower illumination minimum than the prior art in which all the lamps $Lp_1$ to $Lp_n$ are conducting.

Similarly, the respective time for the switch control signal $S_{SW1}$ to $S_{SWn-1}$ to turn on the corresponding lamp $Lp_1$ to $Lp_{n-1}$ is set according to design requirements. For example, a plurality of predetermined illumination values can be designed to correspond to one of the switches $SW_1$ to $SW_{n-1}$, with details the same as for multi-lamp driver 600, and not described here for brevity.

Figure 8:
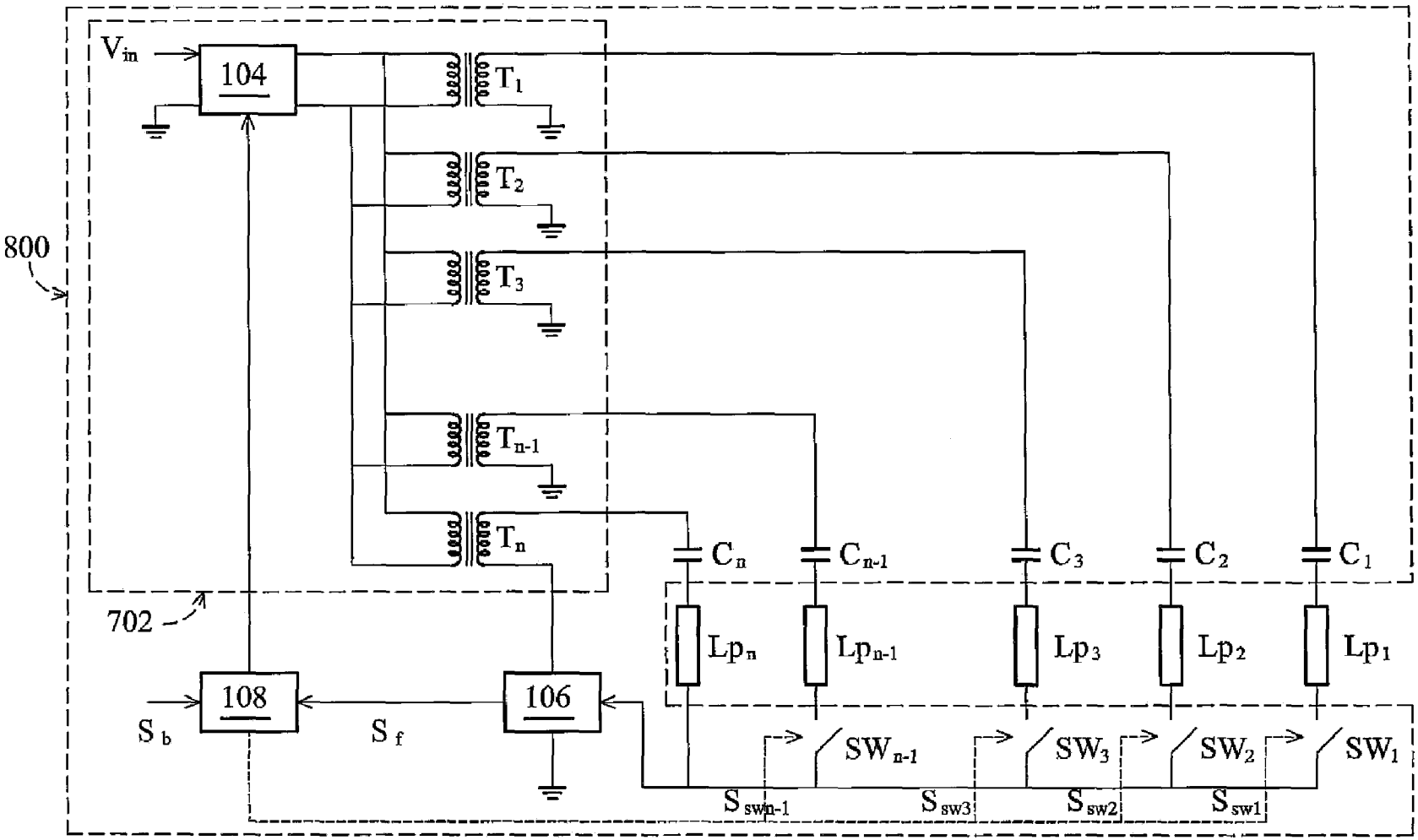
FIG. 8 is a schematic diagram of a multi-lamp driver in accordance with another embodiment of the invention.

FIG. 8 is a schematic diagram of a multi-lamp driver 800 in accordance with another embodiment of the invention, differing from the multi-lamp 700 shown in FIG. 8 in that the switches $SW_1$ to $SW_{n-1}$ in the multi-lamp driver 800 are coupled between the feedback circuit 106 and the low voltage ends of the lamps $Lp_1$ to $Lp_{n-1}$, rather than between the ground and the low voltage ends of the lamps. Similar to multi-lamp 700, the number of conducting lamps and hence the minimum value of total lamp illumination minimum of lamps driven by the multi-lamp driver 800 is decreased. Detailed operation is quite similar to the multi-lamp driver 700, and is thus not described here for brevity.

However, switches can also be coupled to high voltage ends of lamps, as is obvious to those skilled in the art. Further, switches can control the lamps without being directly coupled to lamps. For example, when each of the lamps has a respective transformer, switch(es) can be coupled to a respective primary coil of a corresponding transformer, as described in the following.

Figure 9:
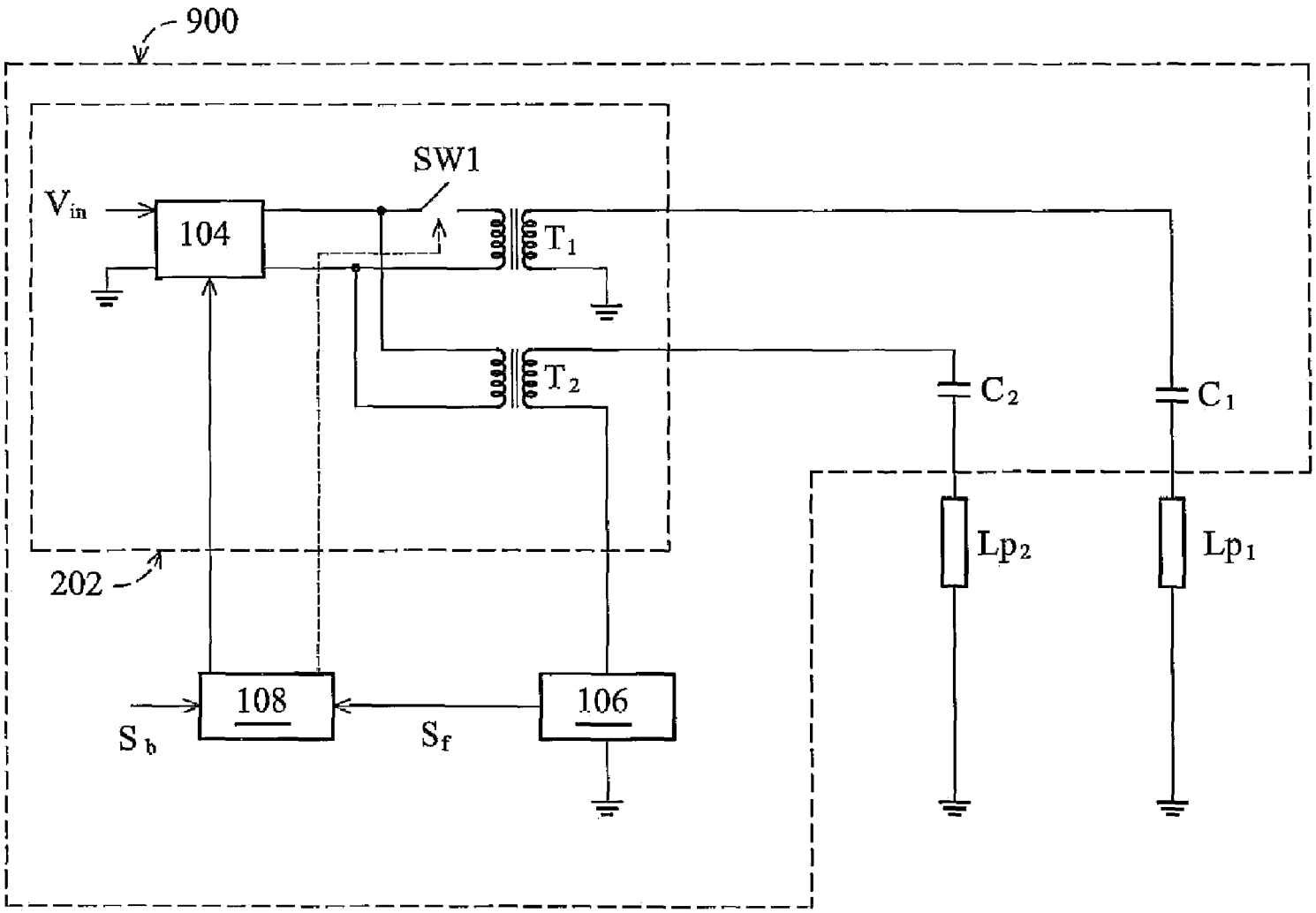
FIG. 9 is a schematic diagram of a multi-lamp driver in accordance with another embodiment of the invention.

FIG. 9 is a schematic diagram of a multi-lamp driver 900 in accordance with another embodiment of the invention. The multi-lamp 900 has an extension structure of the multi-lamp driver 200' in FIG. 4 with the only difference therebetween being the switch $SW_1$ is coupled to primary coil in the transformer T1 rather than the first lamp $Lp_1$. Similar to the multi-lamp driver 200', the first lamp $Lp_1$ is turned off and on responsively when the switch $SW_1$ is turned on and off. The minimum value of total lamp illumination minimum is thus decreased. Moreover, it is noted that the low voltage ends of the lamps $Lp_1$ and $Lp_2$ can be coupled to the feedback circuit 106 (not shown e), similar to the modification from the multi-lamp driver 200' to 200".

Figure 10:
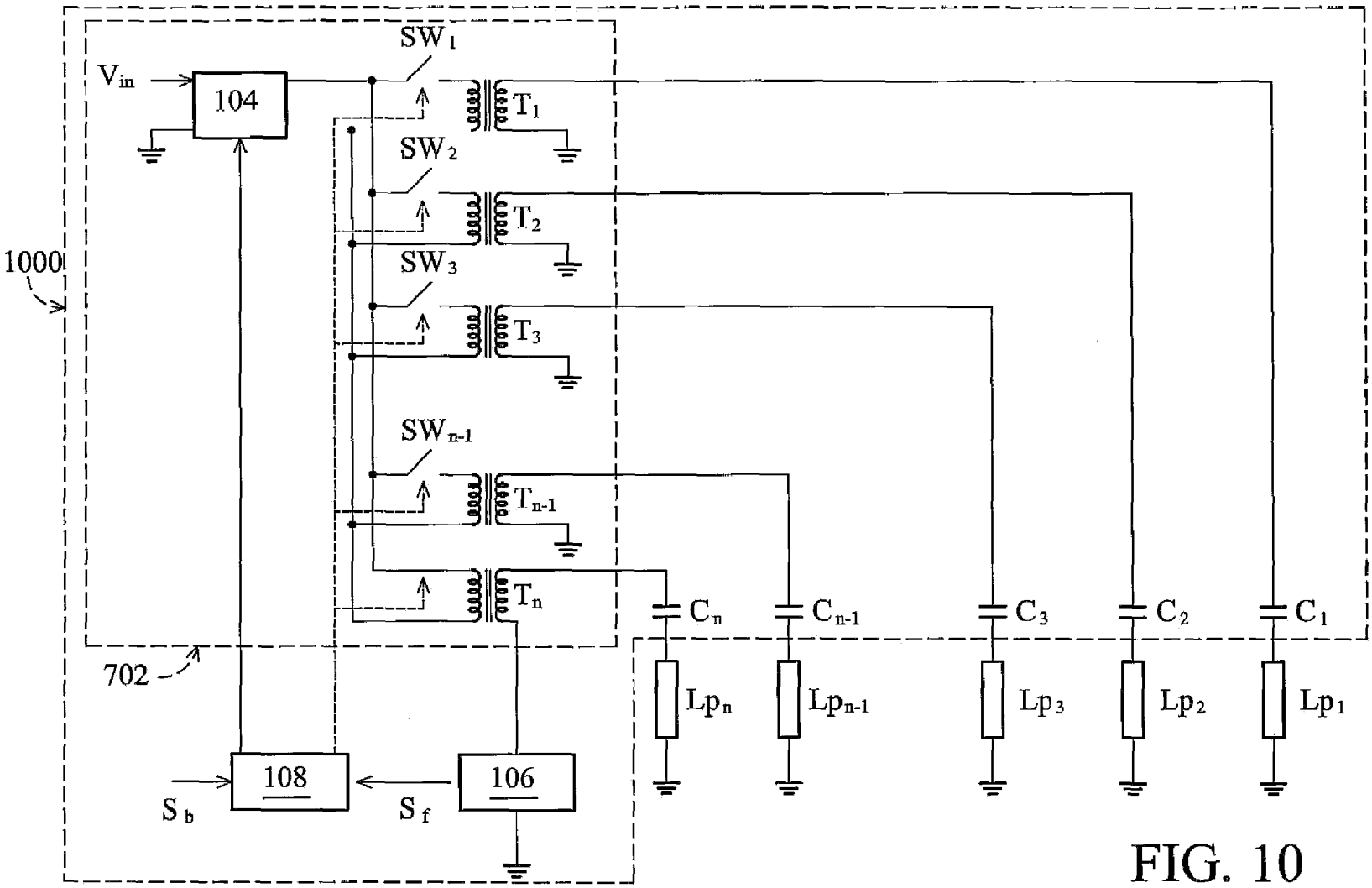
FIG. 10 is a schematic diagram of a multi-lamp driver in accordance with another embodiment of the invention.
Figure 11:
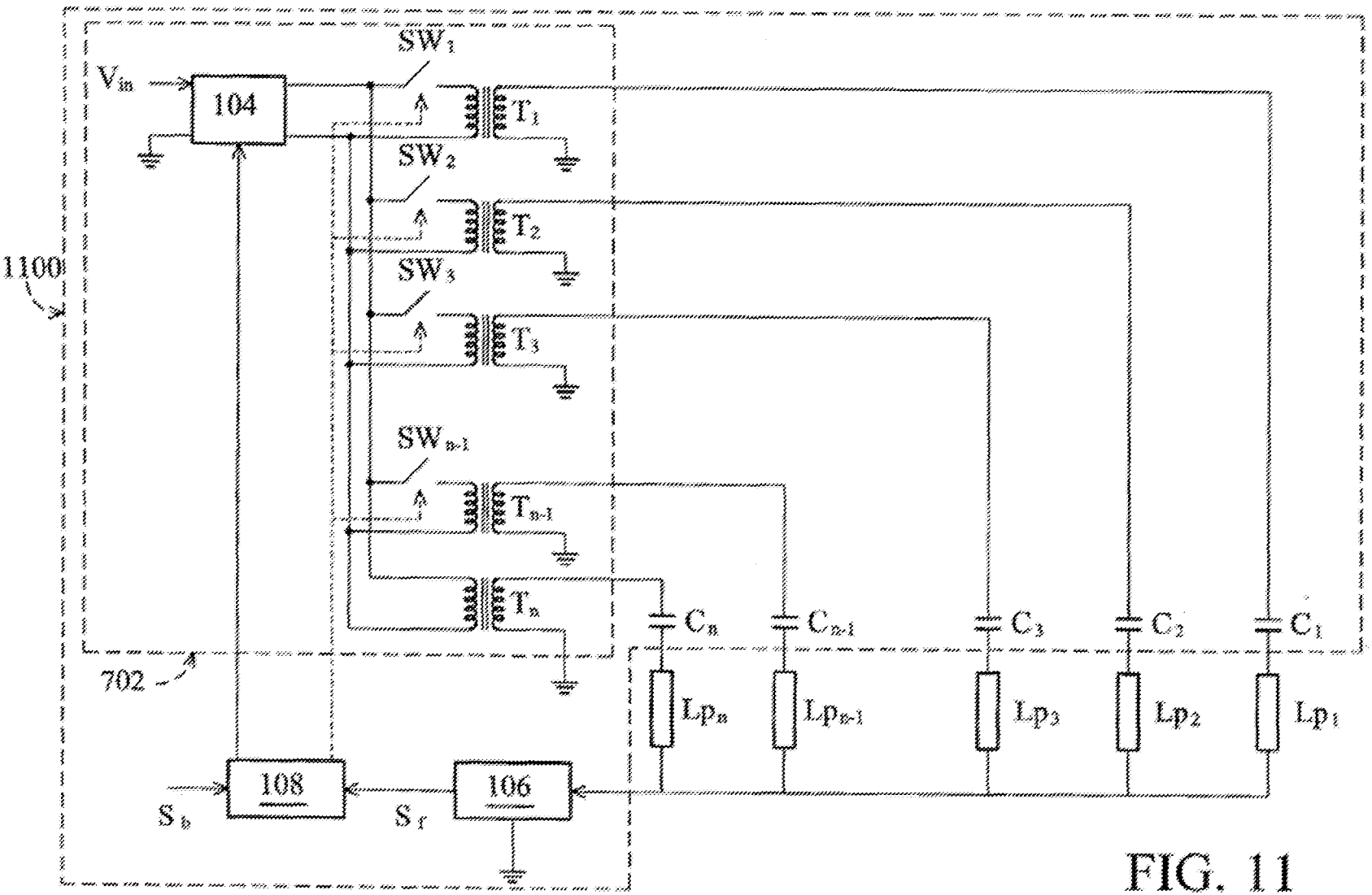
FIG. 11 is a schematic diagram of a multi-lamp driver in accordance with another embodiment of the invention.

Similarly, FIGS. 10 and 11 respectively show multi-lamp drivers 1000 and 1100 having extension structures of FIG. 9 to illustrate no restriction to only two lamps. The multi-lamp drivers 1000 and 1100 are extended from the multi-lamp drivers 700 in FIG. 7 and 800 in FIG. 8, respectively. The only difference is that the switches $SW_1$ to $SW_{n-1}$ are coupled to the primary coils in transformers $T_1$ to $T_{n-1}$ rather than lamps $Lp_1$ to $Lp_{n-1}$. When one of the switches $SW_1$ to $SW_{n-1}$ is turned on or off, the corresponding lamp is turned on or off responsively. The minimum values of total lamp illumination minimum of lamps driven by the multi-lamp driver 1000 and 1100 are decreased. Detailed operations of the multi-lamp drivers 1000 and 1100 are similar to those of the multi-lamp drivers 700 and 800, and are thus not described here for brevity.

It should be noted that in all the above multi-lamp drivers, the number of switches is equal to the number of lamps less one, such that one lamp is left turned on eventually and the total lamp illumination is controlled through the feedback circuit. However, in the invention, even with only one switch, the minimum value of total lamp illumination is still lower than the prior art. The number of switches varies with requirement. Moreover, each switch can be coupled to more than one lamp, and accordingly, when any switch is turned on or off, more than one lamp is turned on or off responsively.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multi-lamp driver, comprising:

a power driver coupled to a plurality of lamps to supply power thereto;

a feedback circuit coupled to at least one of the lamps to generate a feedback signal;

a control circuit coupled between the feedback circuit and the power driver to control the power driver according to an illumination control signal and the feedback circuit for adjustment of total illumination of the plurality of lamps; and switch controlled by the control circuit to turn M lamps of the plurality of lamps on or off respectively, wherein the illumination control signal sets value of the total illumination of the plurality of lamps by comparing the value with predetermined value, each of the predetermined values associated with one of the lamps, and when the value is greater than an $N^{th}$ predetermined value among the predetermined value, the illumination control signal turns on N switches associated with the predetermined value and turns off the other switches.

2. The multi-lamp driver of claim 1, wherein the switch and the lamp controlled by the switch are coupled to each other.

3. The multi-lamp driver of claim 1, wherein when the switch change from on to off and from off to on, the control circuit drives the power driver to increase and decrease the supplied power respectively for reduction of a sudden drop in the total lamp illumination.

4. The multi-lamp driver of claim 1, wherein the power driver comprises a driving circuit and a transformer circuit, the driving circuit controlled by the control circuit to convert DC voltage to AC voltage for supply to the transformer circuit, and the transformer circuit converts AC voltage to another AC voltage for supply to the plurality of lamps.

5. The multi-lamp driver of claim 4, wherein the transformer circuit comprises a transformer having a primary coil coupled to the driving circuit and a secondary coil coupled to the plurality of lamps.

6. A multi-lamp driver, comprising:

a power driver coupled to a plurality of lamps to supply power thereto and comprising a driving circuit and a transformer circuit, wherein the transformer circuit comprises a plurality of transformers, each having a primary coil coupled to the driving circuit and a secondary coil coupled to one of the lamps;

a feedback circuit coupled to at least one of the lamps to generate a feedback signal, wherein at least one of the secondary coils is further coupled to the feedback circuit;

a control circuit coupled between the feedback circuit and the power driver to control the power driver according to an illumination control signal and the feedback circuit for adjustment of total illumination of the lamps, wherein the driving circuit is controlled by the control circuit to convert DC voltage to AC voltage for supply to the transformer circuit, and the transformer circuit converts AC voltage to another AC voltage for supply to the lamps; and at least one switch controlled by the control circuit to turn at least one of the lamps on or off.

7. The multi-lamp driver of claim 6, wherein the at least one switch is coupled to at least one of the primary coils not coupled to the feedback circuit.

8. A multi-lamp driver, comprising:

a power driver coupled to first and second lamps to provide power thereto;

a feedback circuit coupled to at least one of the first and second lamps to generate a feedback signal;

a control circuit coupled to the feedback circuit and the power driver to control the power driver according to an illumination control signal and the feedback circuit for adjustment of total lamp illumination of the first and second lamps; and a switch controlled by the control circuit to turn one of the first and second lamps on or off, wherein the illumination control signal sets value of the total illumination of the first and second lamps by comparing the value with a predetermined value, and when the value is greater and lower than the predetermined value, the illumination control signal turns on and off the switch respectively.

9. The multi-lamp driver of claim 8, wherein the switch and the lamp controlled by the switch are coupled to each other.

10. The multi-lamp driver of claim 8, wherein when the switch changes from on to off and from off to on, the control circuit drives the power driver to increase and decrease the supplied power respectively for reduction of a sudden drop in total lamp illumination.

11. The multi-lamp driver of claim 8, wherein the power driver comprises a driving circuit and a transformer circuit, wherein the driving circuit is controlled by the control circuit to convert DC voltage to AC voltage for supply to the transformer circuit, and the transformer circuit converts AC voltage to another AC voltage for supply to the first and second lamps.

12. The multi-lamp driver of claim 11, wherein the transformer circuit comprises a transformer having a primary coil coupled to the driving circuit and a secondary coil coupled to the first and second lamps.

13. A multi-lamp driver, comprising:

a power driver coupled to first and second lamps to provide power thereto and comprising a driving circuit and a transformer circuit, wherein the transformer circuit comprises a first and second transformer, each having a primary coil coupled to the driving circuit and a secondary coil coupled to one of the first and second lamps;

a feedback circuit coupled to at least one of the first and second lamps to generate a feedback signal, wherein the secondary coil of the second transformer is further coupled to the feedback circuit;

a control circuit coupled to the feedback circuit and the power driver to control the power driver according to an illumination control signal and the feedback circuit for adjustment of total lamp illumination of the first and second lamps, wherein the driving circuit is controlled by the control circuit to convert DC voltage to AC voltage for supply to the transformer circuit, and the transformer circuit converts AC voltage to another AC voltage for supply to the first and second lamps; and a switch controlled by the control circuit to turn one of the first and second lamps on or off.

14. The multi-lamp driver of claim 13, wherein the switch is coupled to the primary coil of the first transformer.

* * * * *